US007272329B2

(12) United States Patent
Kang

(10) Patent No.: US 7,272,329 B2
(45) Date of Patent: Sep. 18, 2007

(54) IMAGE FORMING APPARATUS WITH DEVELOPING UNITS DETACHABLE FROM A MOUNTING PORTION

(75) Inventor: Nae-wan Kang, Anayang-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 191 days.

(21) Appl. No.: 11/179,482

(22) Filed: Jul. 13, 2005

(65) Prior Publication Data

US 2006/0013600 A1 Jan. 19, 2006

(30) Foreign Application Priority Data

Jul. 15, 2004 (KR) ..... 10-2004-0055139

(51) Int. Cl.
*G03G 15/00* (2006.01)

(52) U.S. Cl. ..... 399/13

(58) Field of Classification Search ..... 399/13, 399/223, 120, 227

See application file for complete search history.

(56) References Cited

U.S. PATENT DOCUMENTS

| | | | | |
|---|---|---|---|---|
| 4,931,837 | A * | 6/1990 | Abuyama et al. | 399/13 |
| 2005/0095017 | A1* | 5/2005 | Kikuchi | 399/12 |

FOREIGN PATENT DOCUMENTS

| | | | |
|---|---|---|---|
| JP | 03-163476 | | 7/1991 |
| JP | 06-027814 | | 2/1994 |
| JP | 07253713 | A * | 10/1995 |
| JP | 11-133839 | | 5/1999 |
| JP | 2001056607 | A * | 2/2001 |
| KR | 2003-0057279 | | 7/2003 |

* cited by examiner

*Primary Examiner*—Quana Grainger
(74) *Attorney, Agent, or Firm*—Roylance, Abrams, Berdo & Goodman LLP

(57) ABSTRACT

An image forming apparatus comprises a main body having a mounting portion and a sensing portion disposed on one sidewall of the mounting portion. A developing unit assembly has a plurality of developing units and a contacting portion is disposed on one of the developing units. The contacting portion selectively contacts the sensing portion. The bottom surface of the mounting portion is declined to block the contacting portion from contacting the sensing portion prior to the installation of all of the developing units on the mounting portion. The angle of the bottom surface becomes larger when going towards the interior of the mounting portion. The contacting portion is installed on only one developing unit, but whether the other developing units are mounted can be sensed by using the contacting portion, thereby avoiding the use of multiple contacting portions. An image forming apparatus fabricated with this structure is smaller, simpler, and has reduced manufacturing costs.

16 Claims, 10 Drawing Sheets

IMAGE FORMING APPARATUS WITH DEVELOPING UNITS DETACHABLE FROM A MOUNTING PORTION

CROSS-REFERENCE TO RELATED APPLICATIONS

This application claims the benefit under 35 U.S.C. §119 (a) of Korean Patent Application Serial No. 2004-55139, filed on Jul. 15, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an apparatus for detecting the presence of a developing unit assembly formed by a plurality of developing units and an image forming apparatus employing the same.

2. Description of the Related Art

An electrophotographic image forming apparatus, such as a laser printer, a light emitting diode (LED) printer, a facsimile, a digital photocopier, or a multifunction device, generates visible images on a printing medium in response to digital signals input from a computer or a scanner by performing a series of image forming processes.

In a typical image forming apparatus, a developing unit assembly is an integral structure so that the entire developing unit assembly can be exchanged as necessary. There are various reasons for exchanging a developing unit, including removing and replacing the developing unit when inner parts of a main body of the image forming apparatus must be cleaned or repaired; replacing the unit when the photosensitive medium reaches the limit of its useful lifespan, and replacing the unit when the developer in the unit is exhausted. Integral developing unit assemblies are generally one of two types. In the first type, a photosensitive medium, a developing roller and a developer container are all integrated into one, single developing unit. In the second type, the developer container and the developing roller are formed into one unit and the photosensitive medium is formed as another unit. These two units together make up the developing unit assembly.

FIG. 1 is a cross-sectional view of a conventional image forming apparatus with the second type of developing unit assembly, that is, a developing unit assembly formed by two units. The developing unit assembly 150 of the image forming apparatus is mounted inside a mounting portion 120 of a main body 110. The developing unit assembly 150 includes a first developing unit 160 and a second developing unit 170. The first developing unit 160 includes a developer container 164 and a developing roller 162, and the second developing unit 170 includes a photosensitive medium 172. In a large capacity image forming apparatus, the second developing unit 170 typically has a lifespan three to four times longer than that of the first developing unit 160. Hence, the first developing unit 160 is exchanged more frequently than the second developing unit 170.

The first and second developing units 160 and 170 are mounted on the mounting portion 120 so that they function integrally during operation of the image forming apparatus. In other words, although not illustrated, a charging roller charges a surface of the photosensitive medium 172 uniformly, and an electrostatic image is formed by a scanned light generated by a laser scanning unit (not shown). A developer supplied from the developer container 164 is applied to the electrostatic image to form a visible image. The visible image is then transferred onto a printing medium (which is provided from a printing paper feed unit 180) by a transfer roller (not shown). The transferred image is fixed onto the printing medium by a fixing unit and is delivered to a stacker.

A first contacting portion 166 and a second contacting portion 174 are formed on the rear sides of the first developing unit 160 and the second developing unit 170, respectively. The first and second contacting portions 166 and 174 indicate whether or not the first and second developing units 160 and 170 are installed in the mounting portion 120. A first sensing portion 116 and a second sensing portion 114 are mounted inside the mounting portion 120 of the main body 110. The first and second sensing portions 116 and 114 are located at regions corresponding to the first and second contacting portions 166 and 174 so that they contact the first and second contacting portions 166 and 174 when the developing units are installed. Preferably, the first and second contacting portions 166 and 174 include a CRUM (Customer Replaceable Unit Monitor) in the form of semiconductor chip. The CRUM stores information regarding the characteristics and lifespan of elements such as the photosensitive medium, the developing roller, and the developer.

When the first developing unit 160 and the second developing unit 170 are mounted in the mounting portion 120 of the main body 110, the first and second contacting portions 166 and 174 contact the first and second sensing portions 116 and 114, respectively. Therefore, the image forming apparatus detects the presence of the developing unit assembly 150, as well as any information stored by the CRUM which is required for printing operations.

In the conventional image forming apparatus described thus far, the first and second contacting portions 166 and 174 are formed in the first and second developing units 160 and 170, respectively. Thus, the first and second sensing portions 116 and 114 must be installed at corresponding regions of the main body 110. However, a driving unit 117 for driving the developing roller 162 and the photosensitive medium 172, and a power transfer unit 118 for transferring power from the driving unit 117 to the developing roller 162 and the photosensitive medium 172, must also be installed in the main body. Since all of these parts must be installed in the same general area, it is difficult and complicated to find suitable mounting locations for the multiple contacting portions 166 and 174 and sensing portions 116 and 114. Thus, the use of a plurality of contacting and sensing parts increases the required size of the image forming apparatus as well as its manufacturing cost, and hinders the development of a smaller, more cost-effective image forming apparatus.

Accordingly, there is a need for an image-forming apparatus with an improved apparatus for detecting the presence of a developer unit formed of a plurality of parts.

SUMMARY OF THE INVENTION

An aspect of the present invention is to solve at least the above problems and/or disadvantages and to provide at least the advantages described below. Accordingly, an object of the present invention to provide a smaller, more cost-effectively manufactured, image forming apparatus.

In accordance with an aspect of the present invention, an image forming apparatus includes a main body provided with a mounting portion and a sensing portion disposed on one sidewall of the mounting portion. A developing unit assembly having a plurality of developing units is attachable to and detachable from the mounting portion. A contacting portion is disposed on one of the plurality of developing units to make contact with the sensing portion. The bottom surface of the mounting portion is sloped to prevent the contacting portion from making contact with the sensing portion before the plurality of developing units are mounted on the mounting portion. Preferably, the angle of the sloped bottom surface increases when moving towards the interior of the mounting portion from the exterior of the mounting portion.

With this structure, when only one developing unit is mounted on the mounting portion of the main body, the contacting portion is prevented from making contact with the sensing portion. Thus, the apparatus senses when other developing units are not mounted on the mounting portion, thereby preventing erroneous operation of the image forming apparatus.

The image forming apparatus preferably further comprises at least one position adjustment guide member for causing the developing unit on which the contacting portion is disposed to contact the sensing portion.

The developing unit assembly can comprise a first developing unit with a developing roller and a second developing unit with a photosensitive medium. The contacting portion is preferably installed on the first developing unit.

The at least one position adjustment guide members can include a first position adjustment guide member installed on the first developing unit and a second position adjustment guide member installed on the second developing unit. It is preferred that the second position adjustment guide member interferes with the first position adjustment guide member to cause the first developing unit to contact the sensing portion. Hence, because of this interference, the mounting of the first developing unit and the second developing unit can be sensed only when both of the first developing unit and the second developing unit are mounted on the mounting portion.

Additionally, it is preferred that the mounting portion includes a guide rail and the second developing unit further includes a sliding guide member guided by the guide rail.

In accordance with another aspect of the present invention, an image forming apparatus includes a main body with a mounting portion, and a sensing portion disposed on one sidewall of the mounting portion. A developing unit assembly including a plurality of developing units is attachable to and detachable from the mounting portion. A contacting portion is disposed on one of the plurality of developing units and contacts the sensing portion. An anti-contact member blocks the contacting portion from contacting the sensing portion before the plurality of developing units is mounted on the mounting portion.

Preferably, the anti-contact member is an elastic member installed on either the mounting portion or one developing unit selected from the plurality of developing units. When only one of the developing units on which the contacting portion is mounted is installed on the mounting portion, the elastic member forces the developing unit away from the sensing portion. Accordingly, the contacting portion and the sensing portion do not contact each other.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

In accordance with a first embodiment of the present invention, an image forming apparatus is constructed with a developing unit assembly including one unit with a developing roller and a developer container and another unit with a photosensitive medium. For convenience, the unit with the developing unit and the developer container will be referred to as the first developing unit and the unit with the photosensitive medium will be referred to as the second developing unit.

Figure 2:
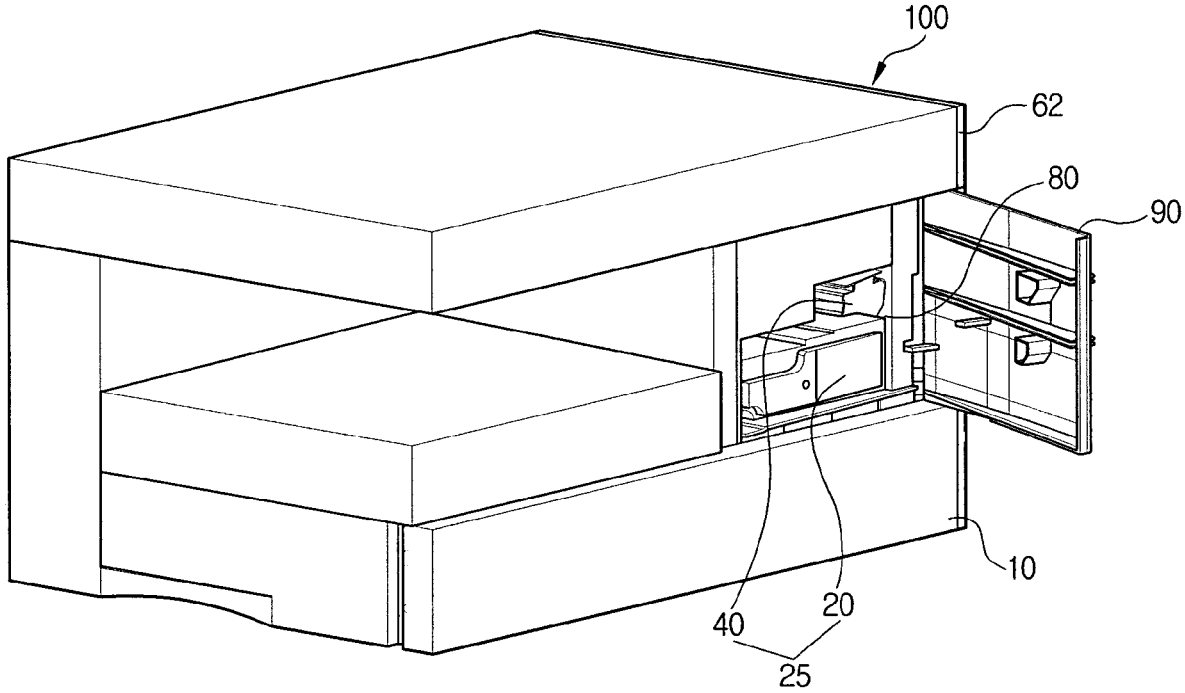
FIG. 2 is a schematic perspective view of an image forming apparatus in accordance with a first embodiment of the present invention.

Referring to FIG. 2, the image forming apparatus includes a main body 100. A front door 90 is disposed in the front of the main body 100. The front door 90 provides access to a mounting portion 80. A side door 62 is disposed on the side of the main body 100. A developing unit assembly 25 is disposed in, and is attachable to and detachable from, the mounting portion 80 of the main body 100. The developing unit assembly 25 includes a first developing unit 20 and a second developing unit 40. The image forming apparatus further includes a printing paper feed unit 10 for storing printing paper and supplying sheets of printing paper. Preferably, the printing paper feed unit 10 is disposed beneath the mounting portion 80.

A bottom portion of the side door 62 is attached to the main body 100 in a hinged manner to allow the lateral side of the main body 100 to be opened and closed. A transfer roller 60 (shown in FIG. 3) and a printing paper transfer roller (not shown) are disposed inside the side door 62. When the developing unit assembly 25 is mounted on the mounting portion 80, the transfer roller 60 is disposed so that it corresponds to a photosensitive medium 50 (shown in FIG. 3) included in the second developing unit 40. During the printing process, a paper being printed on passes between the photosensitive medium 50 and the transfer roller 60.

Figure 3:
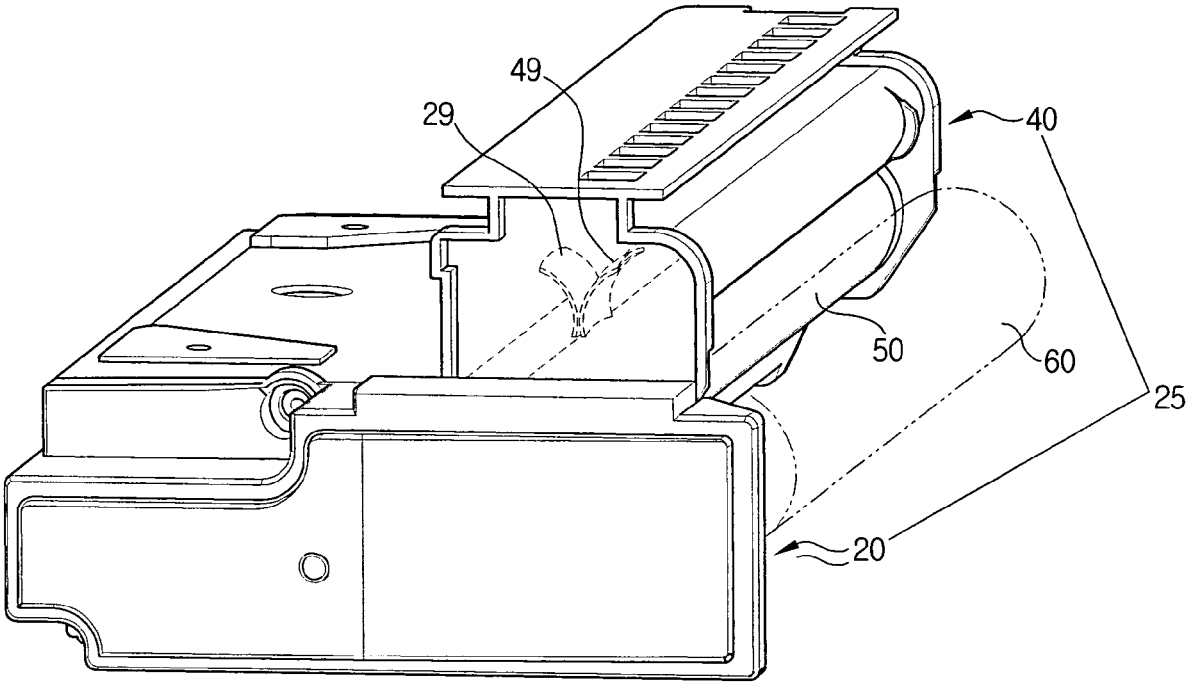
FIG. 3 is a perspective view of the developing unit assembly of the image forming apparatus shown in FIG. 2.

Referring to FIG. 3, the developing unit assembly 25 is mounted on the mounting portion 80 so that the first developing unit 20 and the second developing unit 40 are combined together. Although not illustrated, a laser scanning unit creates an electrostatic image on the photosensitive medium 50 of the second developing unit 40. When the side door 62 is closed and the second developing unit 40 is mounted on the mounting portion 80, the photosensitive medium 50 contacts the transfer roller 60. A first position adjustment guide member 29 and a second position adjustment guide member 49 are included in the first developing unit 20 and the second developing unit 40, respectively. A detailed description of the first and the second position adjustment guide members 29 and 49 is provided later.

Figure 4:
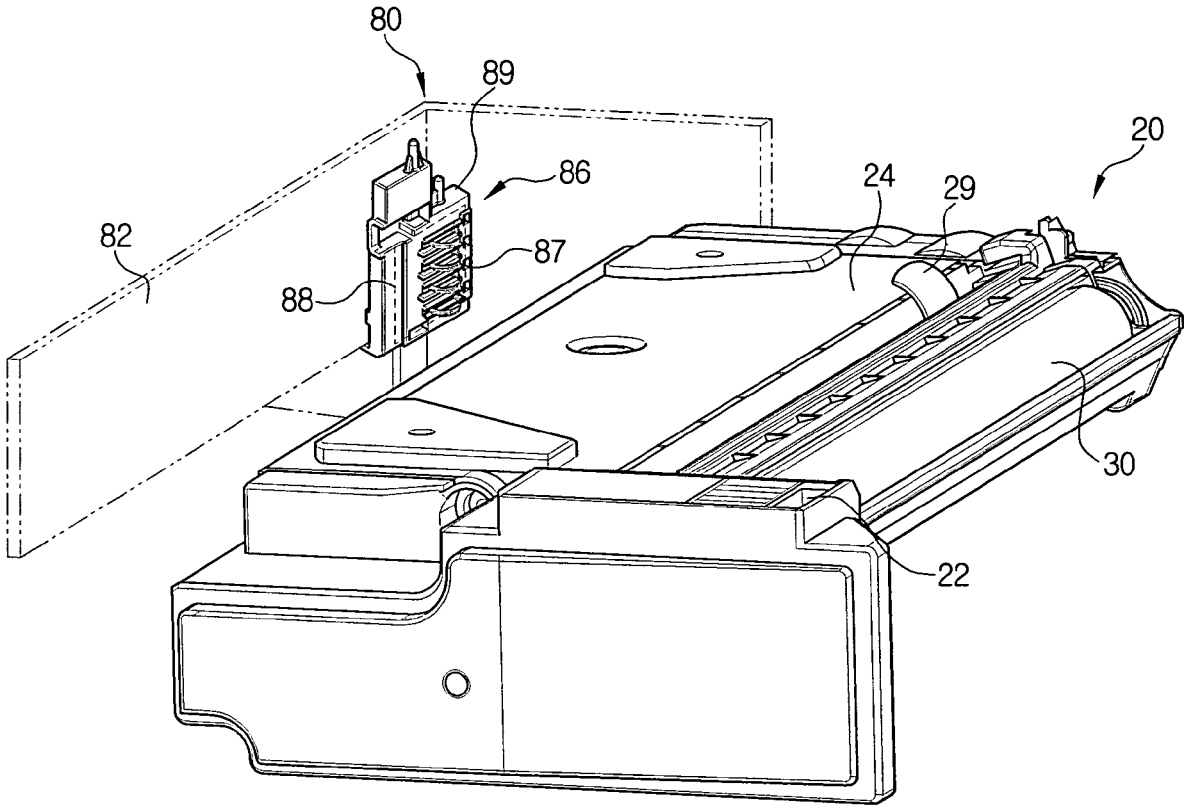
FIGS. 4 and 5 are perspective views showing the first developing unit of the developing unit assembly shown in FIG. 3.
Figure 5:
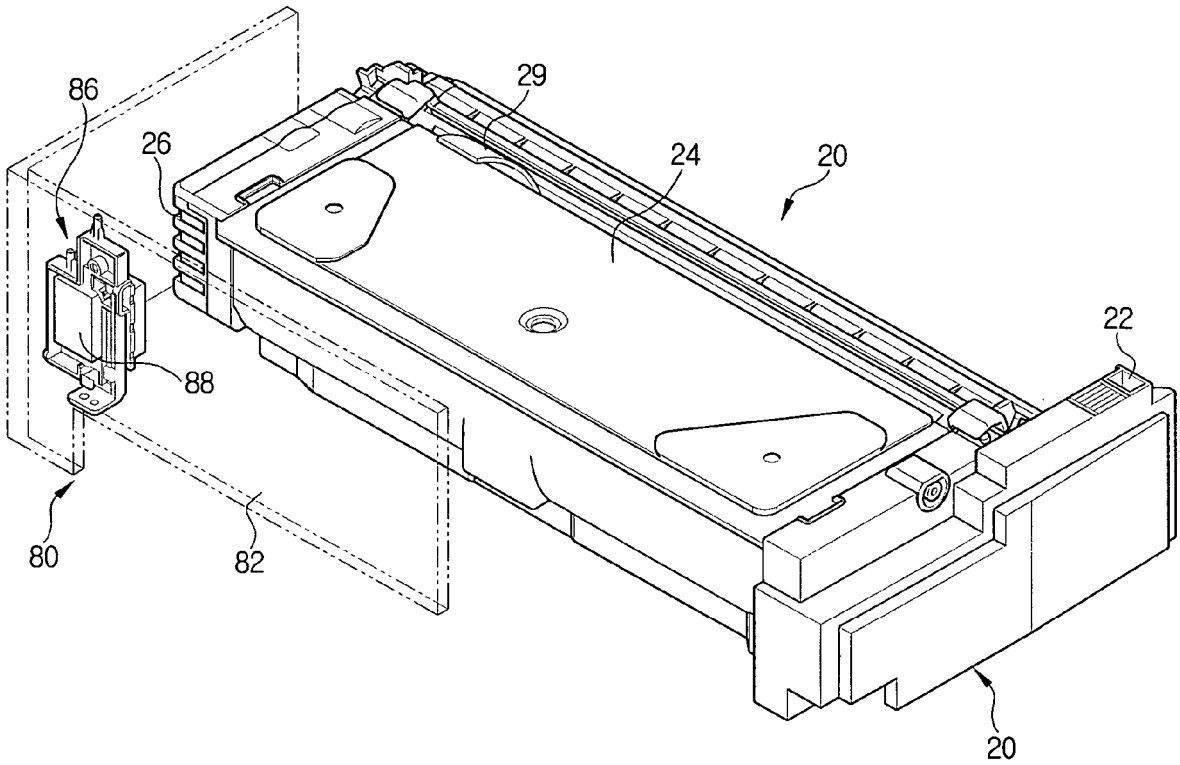

FIGS. 4 and 5 are perspective views of the first developing unit of the first embodiment of the present invention. The first developing unit 20 includes a developing roller 30, a developer container 24, a waste developer storage unit 22, a contacting portion 26, and the above mentioned first position adjustment guide member 29.

The developing roller 30 is disposed in a lengthwise direction of the first developing unit 20; that is, the developing roller 30 is disposed generally parallel to the mounting portion 80. When the first developing unit 20 and the second developing unit 40 are mounted on the mounting portion 80 and combined together, the photosensitive medium 50 of the second developing unit 40 shown in FIG. 3 is supplied with developer.

The developer container 24 is disposed lengthwise along the developing roller 30 and faces the developing roller 30 so that the developer container 24 contacts the developing roller 30. The developer container 24 contains developer and provides the developer to the developing roller 30.

Figure 6:
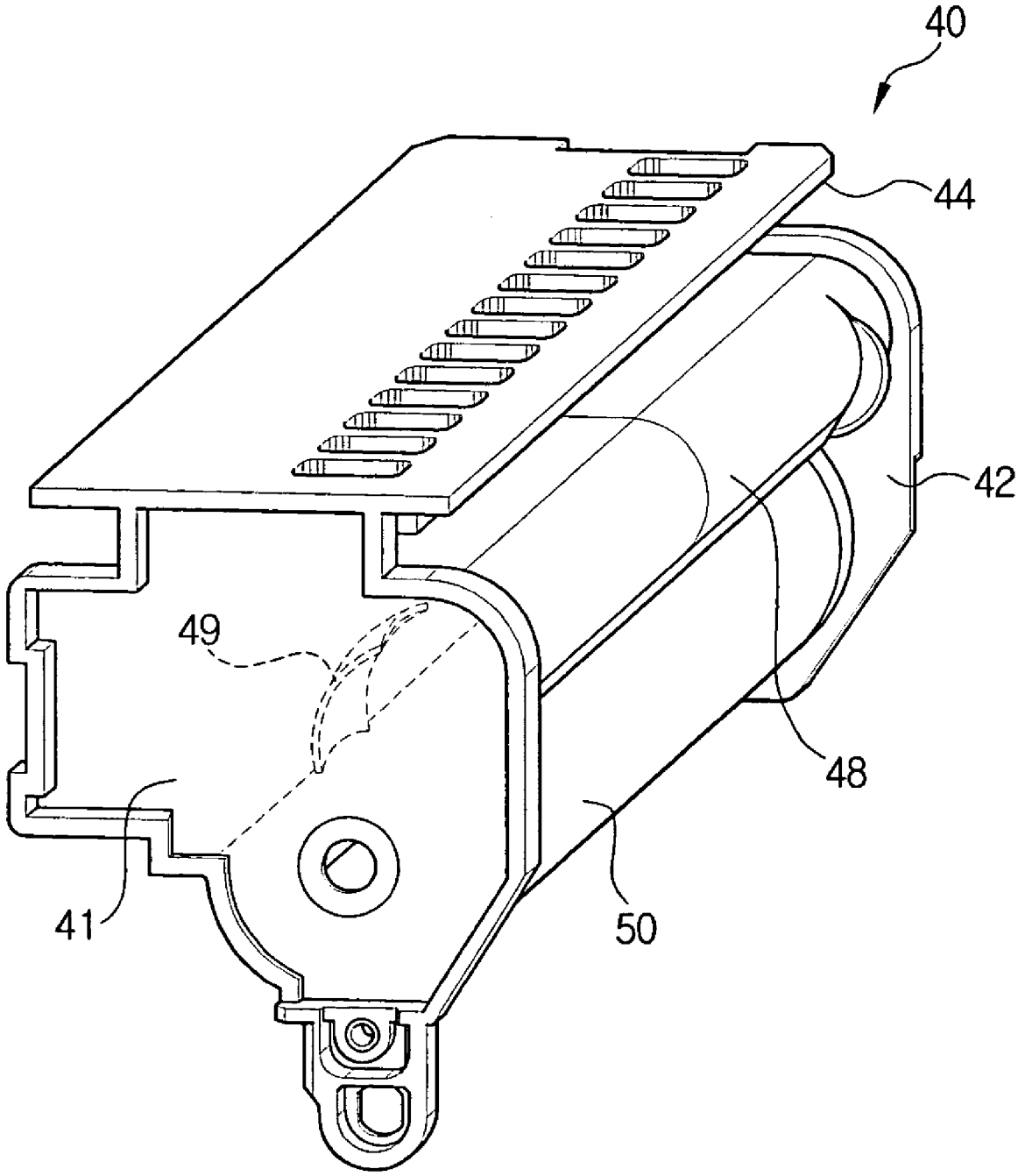
FIG. 6 is a perspective view showing the second developing unit of the developing unit assembly shown in FIG. 3.

The waste developer storage unit 22 is disposed at one side of the developing roller 30 and stores waste developer transferred by a waste developer transfer unit 48 of the second developing unit 40 (refer to FIG. 6). The waste developer storage unit 22 preferably covers the front sides of the developing roller 30 and the photosensitive medium 50 when the first developing unit 20 and the second developing unit 40 are mounted on the mounting portion 80 and combined together. The reason for this configuration is because the lifetime of the photosensitive medium 50 is shortened when it is exposed to direct light, such as when the front door 90 shown in FIG. 2 is opened.

The contacting portion 26 is placed on one lateral surface of the developing unit 20 and contacts a sensing portion 86 mounted on the mounting portion 80, thereby providing the ability to detect whether or not the first developing unit 20 is mounted, and to detect any characteristic history stored in a CRUM. The contact between the contacting portion 26 and the sensing portion 86 also makes it possible to sense whether or not the second developing unit 40 is mounted on the mounting portion 80.

The sensing portion 86 is disposed on one sidewall 82 of the mounting portion 80. More particularly, the sensing portion 86 is disposed at a region corresponding to the contacting portion 26 when the first developing unit 20 is mounted on the mounting portion. As illustrated in FIGS. 4 and 5, a contact part 87 is made of a springy metal and is encased by a case 89. The contact part 87 protrudes outwardly so that the sensing portion 86 contacts the contacting portion 26. A printed circuit board 88 is disposed at the rear side of the sensing portion 86. Preferably, the printed circuit board 88 is connected with a main circuit board (not shown) of the main body 100 by a flex-print connector (FPC) to allow the first developing unit 20 to communicate signals with the image forming apparatus.

The first position adjustment guide member 29 is disposed in an upper part of the first developing unit 20 and interferes with the second position adjustment guide member 49 of the second developing unit 40, thereby moving the first developing unit 20 toward the sidewall 82 on which the sensing portion 86 of the mounting portion 80 is disposed. The operation of the position adjustment guide members will be described in further detail below.

FIG. 6 is a perspective view showing the second developing unit shown in FIG. 2. The second developing unit 40 includes a front frame 41, a rear frame 42, the photosensitive medium 50, the waste developer transfer unit 48, a sliding guide member 44, and the second position adjustment guide member 49.

The sliding guide member 44 is disposed on the upper portion of the second developing unit 40, and the waste developer transfer unit 48 and the photosensitive medium 50 are disposed on the bottom portion of the sliding guide member 44. They are disposed between the front frame 41 and the rear frame 42.

The photosensitive medium 50 is disposed in a lengthwise direction of the second developing unit 40, that is, the photosensitive medium 50 is disposed generally parallel to the mounting portion 80. The ends of the photosensitive medium 50 are rotatably mounted in supports in the front frame 41 and the rear frame 42. Furthermore, the photosensitive medium 50 is disposed in such a manner to receive power from a driving unit 83 (refer to FIG. 8) placed on the mounting portion 80. Additionally, when the photosensitive medium 50 is mounted on the mounting portion 80, the photosensitive medium 50 makes contact with the transfer roller 30 disposed in the main body 100.

The waste developer transfer unit 48 is formed at an upper part of the photosensitive medium 50, and the ends of the waste developer transfer unit 48 are attached to the front frame 41 and the rear frame 42. The waste developer transfer unit 48 separates any developer remaining on the photosensitive medium 50 after the completion of printing, and collects and transfers the collected waste developer into the waste developer storage unit 22 of the first developing unit 20.

One end of the sliding guide member 44 is connected with an upper part of the front frame 41 and helps stabilize the second developing unit 40 in the mounting portion 80 of the main body 100. The sliding guide member 44 is formed along the length of the second developing unit 40 so that the sliding guide member 44 is able to slide along a guide rail 74 (refer to FIG. 10) located along the length of the mounting portion 80. As a result of this sliding action, the second developing unit 40 is accommodated into the mounting portion 80.

The second position adjustment guide member 49 contacts the first position adjustment guide member 29 of the first developing unit 20 and, subsequently interferes with the first position adjustment guide member 29, thereby forcing the first developing unit 20 to the sidewall 82 of the mounting portion 80 on which the sensing portion 86 is disposed. As a result, the contacting portion 26 of the first developing unit 20 contacts the sensing portion 86.

Figure 7A:
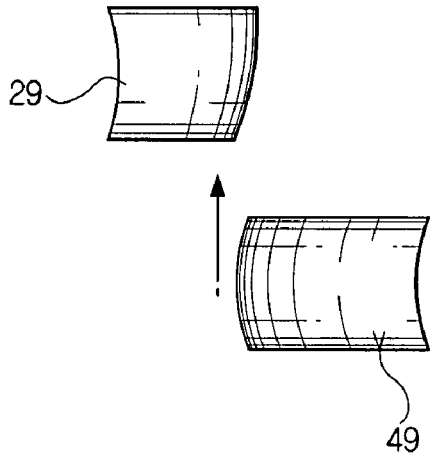
FIGS. 7A to 7C are diagrams illustrating the operation of a first position adjustment guide member and a second position adjustment guide member in accordance with the first embodiment of the present invention.
Figure 7B:
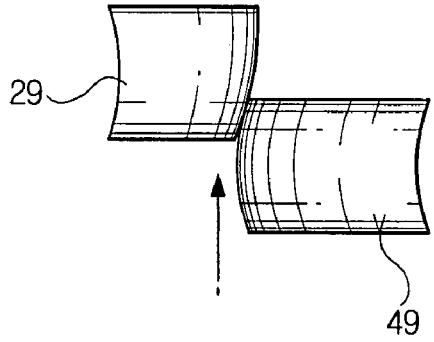
Figure 7C:
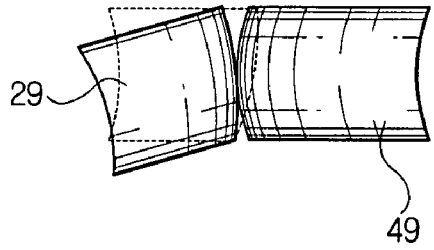
Figure 10:
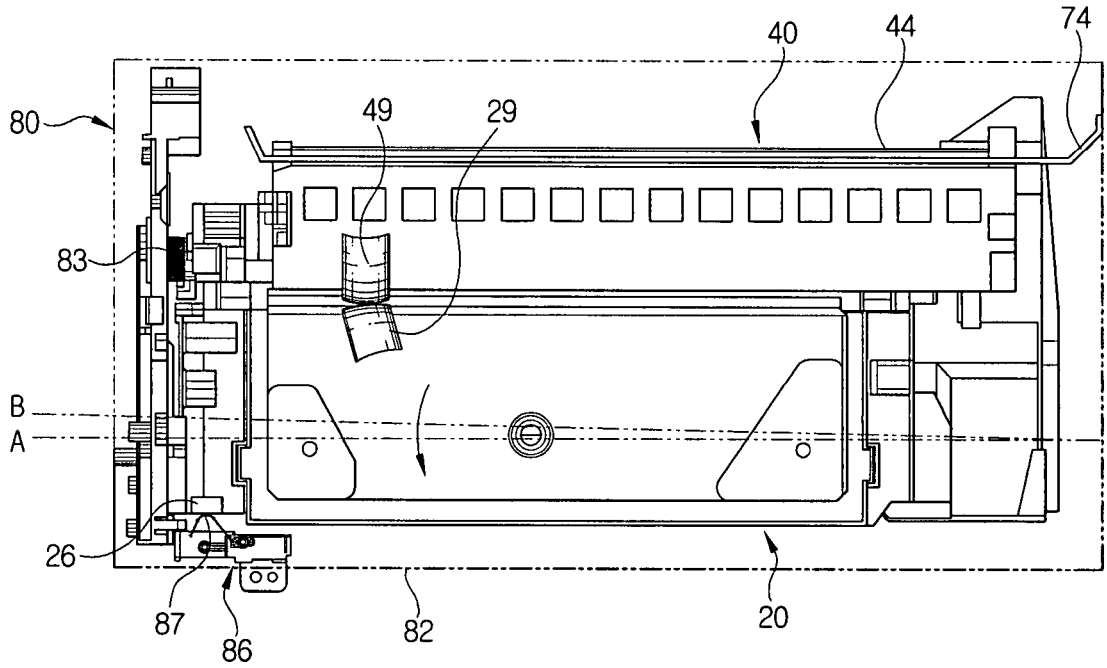
FIG. 10 is a top view of the image forming apparatus of FIG. 2 with both the first developing unit and the second developing unit mounted on the mounting portion.

FIGS. 7A to 7C are diagrams showing the operation of the first position adjustment guide member and the second position adjustment guide member. As illustrated in FIG. 7A, when the first developing unit 20 is mounted on the mounting portion 80, and the second developing unit 40 is installed on the mounting portion 80 by moving it in the direction indicated by the arrow, the second position adjustment guide member 49 contacts the first position adjustment guide member 29. This contact is illustrated in FIG. 7B. As shown in FIG. 7C, as the second developing unit 40 is pushed in farther, the second position adjustment guide member 49 interferes with the first position adjustment guide member 29 and presses the first position adjustment guide member 29. The first position adjustment guide member 29, in turn, presses the first developing unit 20 towards the sidewall 82 of the mounting portion 80. Therefore, the sensing portion 86 and the contacting portion 26 of the first developing unit 20 are forced into contact with each other. FIG. 10 illustrates the contact between the sensing portion 86 and the contacting portion 26.

In a similar fashion, when the first developing unit 20 is mounted on the mounting portion 80 after the second developing unit 40 is mounted on the mounting portion 80, the first position adjustment guide member 29 and the second position adjustment guide member 49 interfere with each other, thereby resulting in contact between the sensing portion 86 and the contacting portion 26.

In the first embodiment of the present invention, the first position adjustment guide member 29 and the second position adjustment guide member 49 are disposed respectively on the first developing unit 20 and the second developing unit 40 to force the contacting portion 26 and the sensing portion 86 into contact with one another. It is also possible to install a further position adjustment guide member that forces the contacting portion 26 of the first developing unit 20 into contact with the sensing portion 86 of the mounting portion 80.

Figure 8:
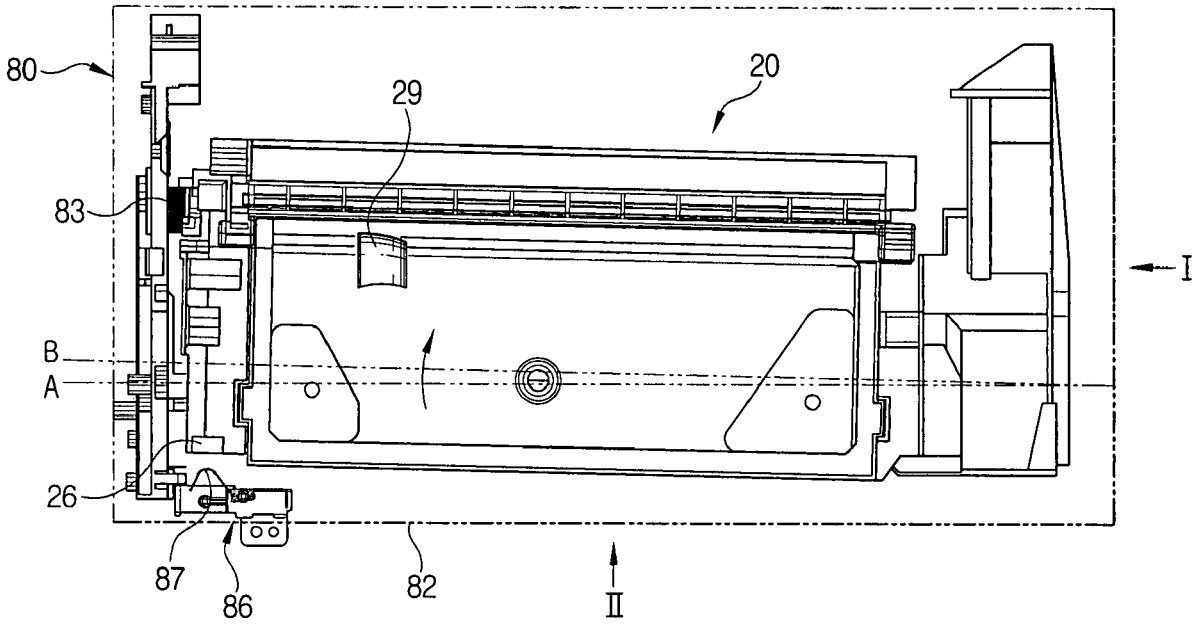
FIG. 8 is a top view of the image forming apparatus of FIG. 2 with only the first developing unit mounted on the mounting portion.
Figure 9A:
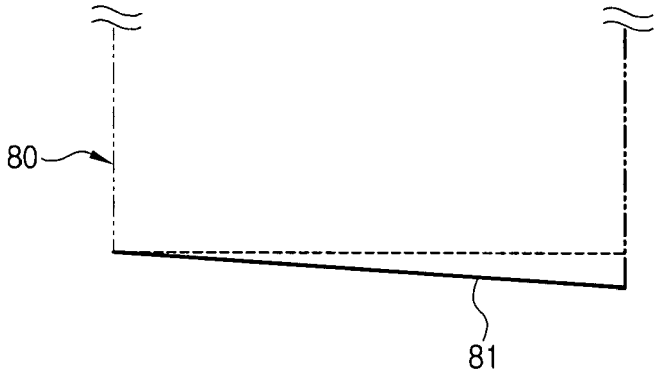
FIGS. 9A and 9B are diagrams showing the bottom side of the mounting portion viewed in directions I and II shown in FIG. 8.
Figure 9B:
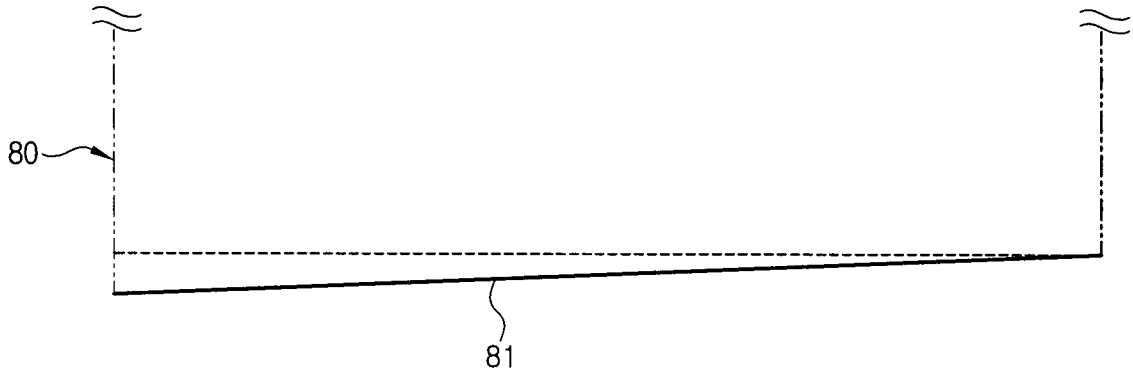

FIG. 8 is a top view showing the first embodiment of the present invention with just the first developing unit mounted. FIGS. 9A and 9B are diagrams showing the mounting portion viewed in the direction of arrows I and II shown in FIG. 8. FIG. 10 is a top view showing the first embodiment of the present invention with both the first developing unit and the second developing unit mounted.

Referring to FIG. 9A, the bottom surface 81 of the mounting portion 80 declines as it progresses away from the sensing portion 86. As shown in FIG. 9B, the bottom surface 81 of the mounting portion 80 declines when moving from the outside to the inside of the mounting portion 80. Hence, when only the first developing unit 20 is mounted on the mounting portion 80 of the main body 100, the first developing unit 20 is spaced apart from the sensing portion 86 installed on the mounting portion 80 because of the weight of the first developing unit 20 and the slope of the bottom surface 81 of the mounting portion 80. That is, the first developing unit 20 moves away from a position A that enables printing because the contacting portion 26 contacts the contact part 87 of the sensing portion 86 to a position B where printing is disabled because the contacting portion 26 installed on the first developing unit 20 is separated from the contact part 87 of the sensing portion 86.

Figure 1:
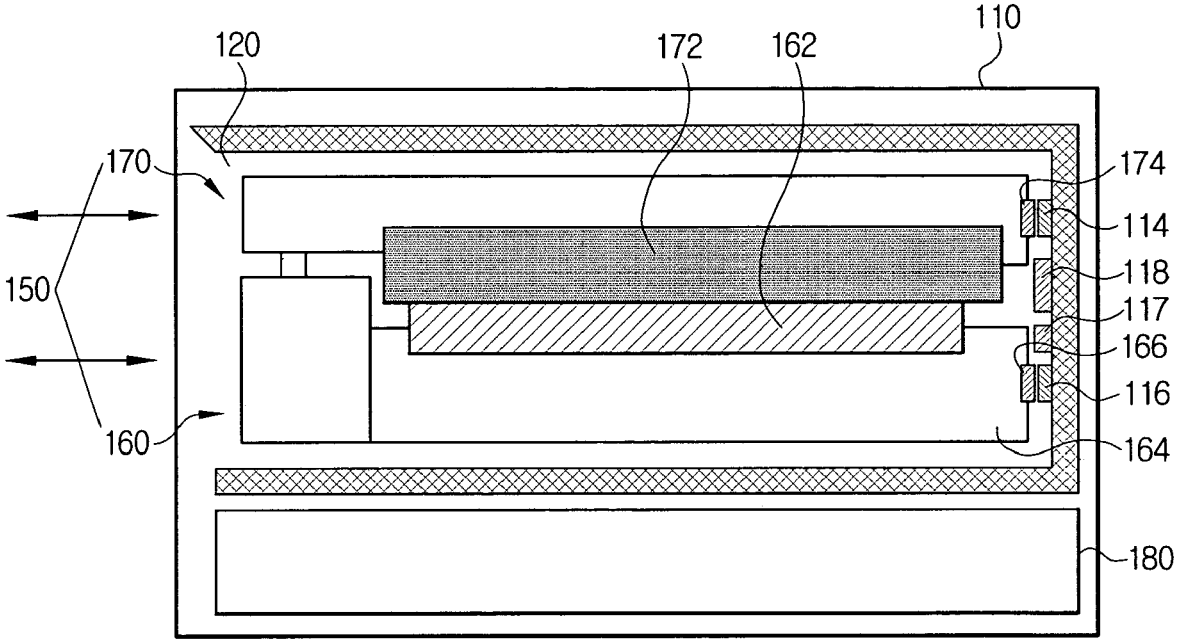
FIG. 1 (PRIOR ART)
FIG. 1 is a schematic cross-sectional view of a conventional image forming apparatus.

To explain in more detail, as a result of the separation between the contacting portion 26 and the sensing portion 86, the image forming apparatus cannot detect whether or not the first developing unit 20 is mounted on the mounting portion 80. Thus, the printing operation is deactivated, and, the image forming apparatus is not susceptible to erroneous operation. In contrast, in a conventional image forming apparatus such as that illustrated in FIG. 1, the first developing unit 160 and the second developing unit 170 are provided with a first contacting portion 166 and a second contacting portion 174, respectively. The first sensing portion 116 and the second sensing portion 114 are installed at regions corresponding to the first and the second contact point units 166 and 174, respectively. The use of multiple sensing portions and contacting portions produces a high risk of erroneous operation when only one of the developing units is installed on the mounting portion 80. In the first embodiment of the present invention, however, the contacting portion 26 is installed only on the developing unit 20, and the sensing portion 86 is installed at a corresponding region of the main body 100. Therefore, it is possible to sense whether or not the first developing unit 20 and the second developing unit 40 are mounted using a single detector, and there is little likelihood of erroneously detecting that a developing unit is installed. Furthermore, the structure of the present invention therefore allows a smaller apparatus that can be more cost-effectively manufactured.

Similarly, when the second developing unit 40 is removed to exchange it for a new one, the first developing unit 20 is pushed back to the original mounting position B and thus, the contacting portion 26 and the contact part 87 of the sensing portion 86 are disconnected. As a result of this disconnection, it is possible to sense that the second developing unit 40 is not mounted.

Referring to FIG. 10, when the first developing unit is installed and the second developing unit 40 is installed by sliding it toward the interior of the mounting portion 80, the second developing unit 40 combines with the first developing unit 20. Specifically, when the second developing unit 40 is installed on the mounting portion 80, the guide rail 74 guides the sliding guide member 44 to press the first developing unit 20 in a direction toward the sensing portion 86. As the second developing unit 40 is mounted on the mounting portion 80, the second position adjustment guide member 49 of the second developing unit 40 and the first position adjustment guide member 29 of the first developing unit 20 contact each other. As the second developing unit 40 slides further into the interior of the mounting portion 80, the second position adjustment 49 presses the first position adjustment guide member 29. Therefore, the first developing unit 20 is pressed towards the sidewall 82 of the mounting portion 80, in other words, towards the sensing portion 86 installed on the mounting portion 80. As a result, the first developing unit 20 moves from the initial position B when only the first developing unit 20 is mounted to position A where the contacting portion 26 can make a contact with the sensing portion 86 of the main body 100, thereby activating the printing operation.

Hence, the image forming apparatus is capable of sensing whether or not both the first developing unit 20 and the second developing unit 40 are mounted on the mounting portion 80. Further, the second developing unit 40 is connected with the driving unit 83 when it is installed in the printer.

Figure 11:
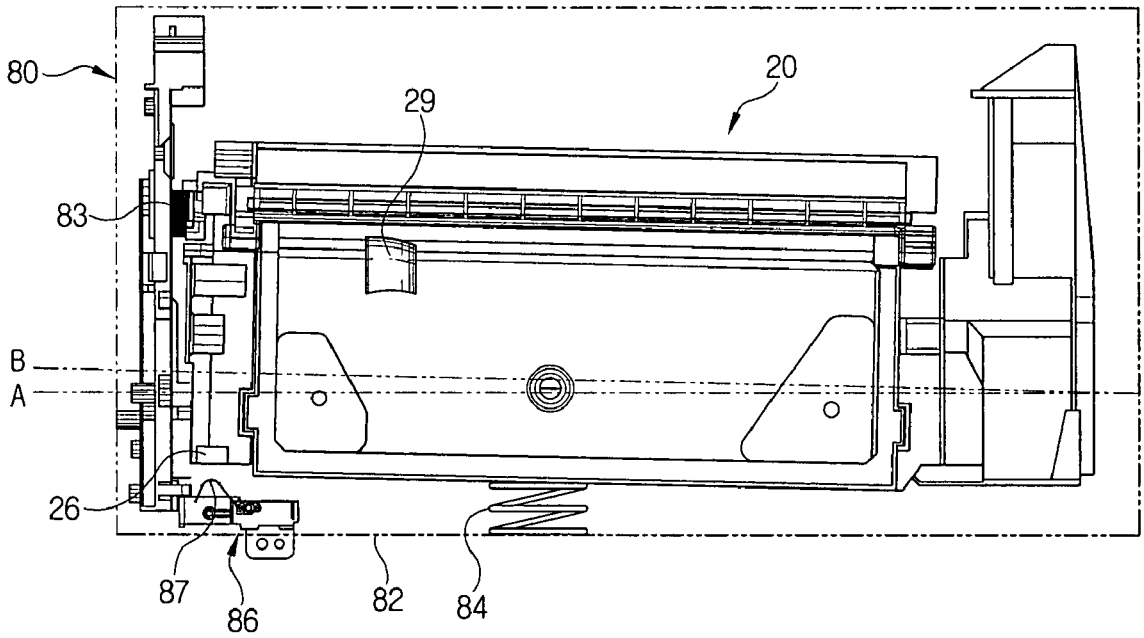
FIG. 11 is a top view of a second embodiment of the present invention with only a first developing unit mounted on a mounting portion.

FIG. 11 is a diagram showing a second embodiment of the present invention with only a first developing unit is mounted on a mounting portion. In this embodiment, an anti-contact member is disposed on the surface where the contacting portion 26 of the first developing unit 20 is installed. In the illustrated exemplary embodiment, the anti-contact member is an elastic member 84.

In this embodiment of the invention, instead of using the declined bottom surface 81 shown in FIGS. 9A and 9B, the elastic member 84 is disposed on the surface where the contacting portion 26 of the first developing unit 20 is installed. The elastic member 84 forcefully pushes the first developing unit 20 away from the surface where the sensing portion 86 is disposed. Thus, when only first developing unit 20 is installed, as illustrated, the sensing portion 86 and the contact part 87 of the first developing unit 20 are separated from each other. That is, the elastic member 84 pushes the first developing unit 20 from a position A at which a printing operation can be carried out because the contacting portion 26 and the contact part 87 contact each other to a position B where the contacting portion 26 and the contact part 87 are separated. As a result, printing operation is disabled. In the same manner as the first embodiment, a second developing unit 40 is mounted on the mounting portion 80 by sliding it along a guide rail 74, which is the same as the one shown in FIG. 10. This mounting of the second developing unit 40 causes the first developing unit 20 to be pressed toward the side wall 82, causing the sensing portion 86 to contact the contacting portion 26. The configuration and operation of the first and second embodiments of the image forming apparatus are similar in other respects, and, therefore, a detailed description is not repeated.

Furthermore, as another embodiment of the present invention, the elastic member 84 can be installed on the sidewall 82 on which the sensing portion 86 of the mounting portion 80 is disposed. The elastic member 84 performs the same function as described with respect to the second embodiment.

In accordance with the exemplary embodiments of the present invention described above, an image forming apparatus has a contacting portion that is mounted on only one of the developing units included in the developing unit assembly. Using this contacting portion, it is possible to detect whether or not the other developing unit is mounted. Accordingly, the present invention allows a simplified structure along with reduced manufacturing costs by using only one contacting portion.

Furthermore, in the exemplary embodiments of the invention described above, the contacting portion is disposed on a surface generally parallel to the direction in which the developing unit is mounted on the mounting portion of the main body. The contacting portion is located at a region where the contacting portion does not overlap with the driving unit of the other developing unit of the main body. With this configuration, it is possible to eliminate the layout limitations with respect to the driving unit of the developing units and the image forming apparatus, thereby allowing a smaller apparatus.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus, comprising:

a main body provided with a mounting portion and a sensing portion disposed on one sidewall of the mounting portion; and a developing unit assembly including a plurality of developing units attachable to and detachable from the mounting portion and a contacting portion disposed on one of the plurality of developing units to make contact with the sensing portion, wherein a bottom surface of the mounting portion is sloped to prevent the contacting portion from contacting the sensing portion before the plurality of developing units are mounted on the mounting portion.

2. The image forming apparatus as recited in claim 1, wherein the bottom surface of the mounting portion declines when progressing from the exterior of the mounting portion towards the interior of the mounting portion.

3. The image forming apparatus as recited in claim 1, further including at least one position adjustment guide member for forcing the developing unit with the contacting portion towards the sensing portion to cause contact between the contacting portion and the sensing portion.

4. The image forming apparatus as recited in claim 3, wherein the developing unit assembly includes: a first developing unit provided with a developing roller and a developer container; and a second developing unit provided with a photosensitive medium, and the contacting portion is installed on the first developing unit.

5. The image forming apparatus as recited in claim 4, wherein said at least one position adjustment guide member includes: a first position adjustment guide member installed on the first developing unit; and a second position adjustment guide member installed on the second developing unit, and the second position adjustment guide member interferes with the first position adjustment guide member to make the contacting portion contact the sensing portion.

6. The image forming apparatus as recited in claim 5, wherein the mounting portion includes a guide rail, and the second developing unit further includes a sliding guide member guided by the guide rail.

7. An image forming apparatus, comprising:

a main body provided with a mounting portion and a sensing portion disposed on one sidewall of the mounting portion;

a developing unit assembly including a plurality of developing units attachable to and detachable from the mounting portion and a contacting portion disposed on one of the plurality of developing units to contact the sensing portion; and an anti-contact member for preventing the contacting portion from contacting the sensing portion before the plurality of developing units are mounted on the mounting portion.

8. The image forming apparatus as recited in claim 7, wherein the anti-contact member is an elastic member disposed on the mounting portion of one developing unit selected from the plurality of developing units.

9. The image forming apparatus as recited in claim 7, further including at least one position adjustment guide member for forcing the developing unit with the contacting portion towards the sensing portion to cause contact between the contacting portion and the sensing portion.

10. The image forming apparatus as recited in claim 9, wherein the developing unit assembly includes: a first developing unit on which the contacting portion is disposed, the first developing unit provided with a developing roller and a developer container; and a second developing unit provided with a photosensitive medium, and the at least one position adjustment guide member includes: a first position adjustment guide member installed on the first developing unit; and a second position adjustment guide member installed on the second developing unit, and the second position adjustment guide member interferes with the first position adjustment guide member to make the contacting portion adhere to the sensing portion.

11. The image forming apparatus as recited in claim 10, wherein the mounting portion includes a guide rail, and the second developing unit further includes a sliding guide member guided by the guide rail.

12. An image forming apparatus, comprising:

a main body with a mounting portion, the mounting portion having at least one sidewall and a sloped bottom surface;

a sensing portion disposed on the at least one sidewall of the mounting portion;

a developing unit assembly including a plurality of developing units attachable to and detachable from the mounting portion; and a contacting portion disposed on one of the plurality of developing units so that it can contact the sensing portion, wherein the contacting portion does not contact the sensing portion until all of the plurality of developing units are mounted on the mounting portion.

13. The image forming apparatus as recited in claim 12, wherein the bottom surface of the mounting portion declines when progressing from the exterior of the mounting portion towards the interior of the mounting portion.

14. The image forming apparatus as recited in claim 12, further comprising at least one position adjustment guide member for forcing the developing unit with the contacting portion towards the sensing portion to cause contact between the contacting portion and the sensing portion.

15. The image forming apparatus as recited in claim 12, wherein the developing unit assembly comprises:

a first developing unit with a developing roller and a developer container; and a second developing unit with a photosensitive medium, the contacting portion being installed on the first developing unit;

and, wherein the at least one position adjustment guide member comprises:

a first position adjustment guide member installed on the first developing unit; and a second position adjustment guide member installed on the second developing unit, the second position adjustment guide member interfering with the first position adjustment guide member to cause contact between the contacting portion and the sensing portion.

16. The image forming apparatus as recited in claim 12, wherein the mounting portion includes a guide rail, and the second developing unit further includes a sliding guide member guided by the guide rail.

* * * * *